US007980640B2

(12) United States Patent
Yang

(10) Patent No.: US 7,980,640 B2
(45) Date of Patent: Jul. 19, 2011

(54) AUTO-RETURN DRAWER RAIL

(76) Inventor: Jun-Long Yang, Tai-Ping (TW)

( * ) Notice: Subject to any disclaimer, the term of this patent is extended or adjusted under 35 U.S.C. 154(b) by 367 days.

(21) Appl. No.: 12/322,131

(22) Filed: Jan. 29, 2009

(65) Prior Publication Data

US 2009/0140621 A1 Jun. 4, 2009

Related U.S. Application Data

(63) Continuation-in-part of application No. 11/983,258, filed on Nov. 8, 2007, now abandoned.

(51) Int. Cl.
*A47B 88/04* (2006.01)

(52) U.S. Cl. ..... 312/333; 312/319.1

(58) Field of Classification Search ..... 312/333, 312/402, 404, 408, 334.11, 334.14, 334.27, 312/334.32, 334.31, 334.44, 334.46, 334.47, 312/319.1; 384/21

See application file for complete search history.

(56) References Cited

U.S. PATENT DOCUMENTS 6,799,817 B1 10/2004 Chu
6,979,066 B2 12/2005 Yang
6,997,528 B2 2/2006 Yang
7,244,005 B1 7/2007 Lu
7,374,260 B2 5/2008 Lu

FOREIGN PATENT DOCUMENTS

EP 0391221 10/1990

OTHER PUBLICATIONS

Office Action issued in parent case U.S. Appl. No. 11/983,258 on Oct. 17, 2008.

*Primary Examiner* — Hanh V Tran
(74) *Attorney, Agent, or Firm* — Wegman, Hessler & Vanderburg

(57) ABSTRACT

An auto-returning drawer rail is implemented in furniture having a drawer cavity and a drawer, and the auto-returning drawer rail has a drawer rail assembly, an auto-returning device and a buffering device. The drawer rail assembly is mounted in the drawer cavity and has a rail bracket, an outer track and an inner track. The auto-returning device is mounted in the drawer rail assembly and has a base, a sliding block, a connector and two springs. The base is mounted on the rail bracket. The sliding block is mounted slidably on the base. The connector is connected securely to the sliding block between the rail bracket and the base and has two clasping tabs engaging the base. The buffering device is mounted in the auto-returning device to prevent the drawer from returning too fast and has a damper and a drive shaft being connected to the connector.

8 Claims, 12 Drawing Sheets

PRIOT ART

AUTO-RETURN DRAWER RAIL

The present invention is a continuation-in-part of application Ser. No. 11/983,258, filed Nov. 8, 2007 now abandoned.

BACKGROUND OF THE INVENTION

1. Field of the Invention

The present invention relates to a drawer rail, and more particularly relates to an auto-return drawer rail with dampening to control an auto-return of a drawer so preventing a base of the auto-return drawer rail from breaking during operation.

2. Description of Related Art

When a drawer is not closed completely, insects or dust may get into the drawer and the drawer causes a hazard to passers-by. To keep a drawer closed completely when not in use, an auto-returning device with a spring is mounted on a drawer rail to provide an auto-returning effect to the drawer. However, the spring of the conventional auto-returning device usually provides a strong force to pull the drawer back, but when this force is too large the drawer may be damaged, thereby shortening a life-span of the drawer.

With reference to FIGS. 9, 10 and 11, another conventional auto-returning drawer rail (50) has a drawer rail assembly (not shown), an auto-returning device (52) and a buffering device (53).

The drawer rail assembly is mounted in a drawer cavity and has multiple tracks (not shown). The tracks are slidably mounted to each other in the drawer cavity.

The auto-returning device (52) is mounted on the drawer rail assembly and has a base (54), a sliding block (55), a connector (56) and two springs (57).

The base (54) is securely mounted on one of the tracks of the drawer rail assembly and has a top, a rear end, two sidewalls and two elongated grooves (541). The elongated holes (541) are respectively formed through the sidewalls of the base (54).

The sliding block (55) is mounted slidably in the base (54) between the sidewalls and has a rear end and two sliding tabs (551) mounted slidably in the elongated holes (541) of the base (54).

The connector (56) is connected to the rear end of the sliding block (55), is mounted in the elongated holes (541) between the sidewalls of the base (54) and has two sides, a rear end, two mounting recesses (561) and two bosses (562). The mounting recesses (561) are formed in the connector (56) parallel each other between the sides and are mounted on the sidewalls of the base (54) in the elongated holes (541). The bosses (562) are respectively formed on and protrude from the sides of the connector (56) and extend out of the elongated holes (541) of the base (54).

The springs (57) are connected to the rear end of the base (54) and the bosses (561) of the connector (56) to pull the sliding block (55) along the elongated holes (541).

The buffering device (53) is mounted in the auto-returning device (52) between the base (54) and the rail bracket assembly and has a damper (58) and a drive shaft (59). The damper (58) is mounted securely in the rear end of the base (54) and has a front end. The drive shaft (59) is mounted slidably in the damper (58), is connected to the rear end of the connector (56) to provide a buffering effect.

Although, the conventional auto-returning drawer rail (50) can prevent the drawer from gaining too much speed and being damaged. Since the elongated holes (541) are formed through the sidewalls of the base (54), structural strength of the base (54) near the top is reduced. In addition, the connector (56) is only slidably mounted in the elongated holes (541) of the base (54) and does not engage or lock the sidewalls of the base (54). With further reference to FIG. 12, the connector (56) may keel and press against the top of the base (54) when moving forward along the elongated holes (541) of the base (54). Then, the base (54) near the elongated holes (541) may be broken due to the connector (56) pressing against the top of the base (54) and reducing a life-span of the base (54) connector.

Therefore, the invention provides an auto-returning drawer rail to mitigate or obviate the aforementioned problems.

SUMMARY OF THE INVENTION

The main objective of the present invention is to provide an auto-returning drawer rail with dampening to control an auto-return of a drawer preventing a base of the auto-return drawer rail from breaking during operation.

The auto-returning drawer rail in accordance with the present invention is implemented in furniture having a drawer cavity and a drawer, and the auto-returning drawer rail has a drawer rail assembly, an auto-returning device and a buffering device. The drawer rail assembly is mounted in the drawer cavity and has a rail bracket, an outer track and an inner track. The auto-returning device is mounted in the drawer rail assembly and has a base, a sliding block, a connector and two springs. The base is mounted on the rail bracket. The sliding block is mounted slidably on the base. The connector is connected securely to the sliding block between the rail bracket and the base and has two clasping tabs engaging the sidewalls of the base. The buffering device is mounted in the auto-returning device, is used to prevent the drawer from returning too fast and has a damper and a drive shaft being connected to the connector.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
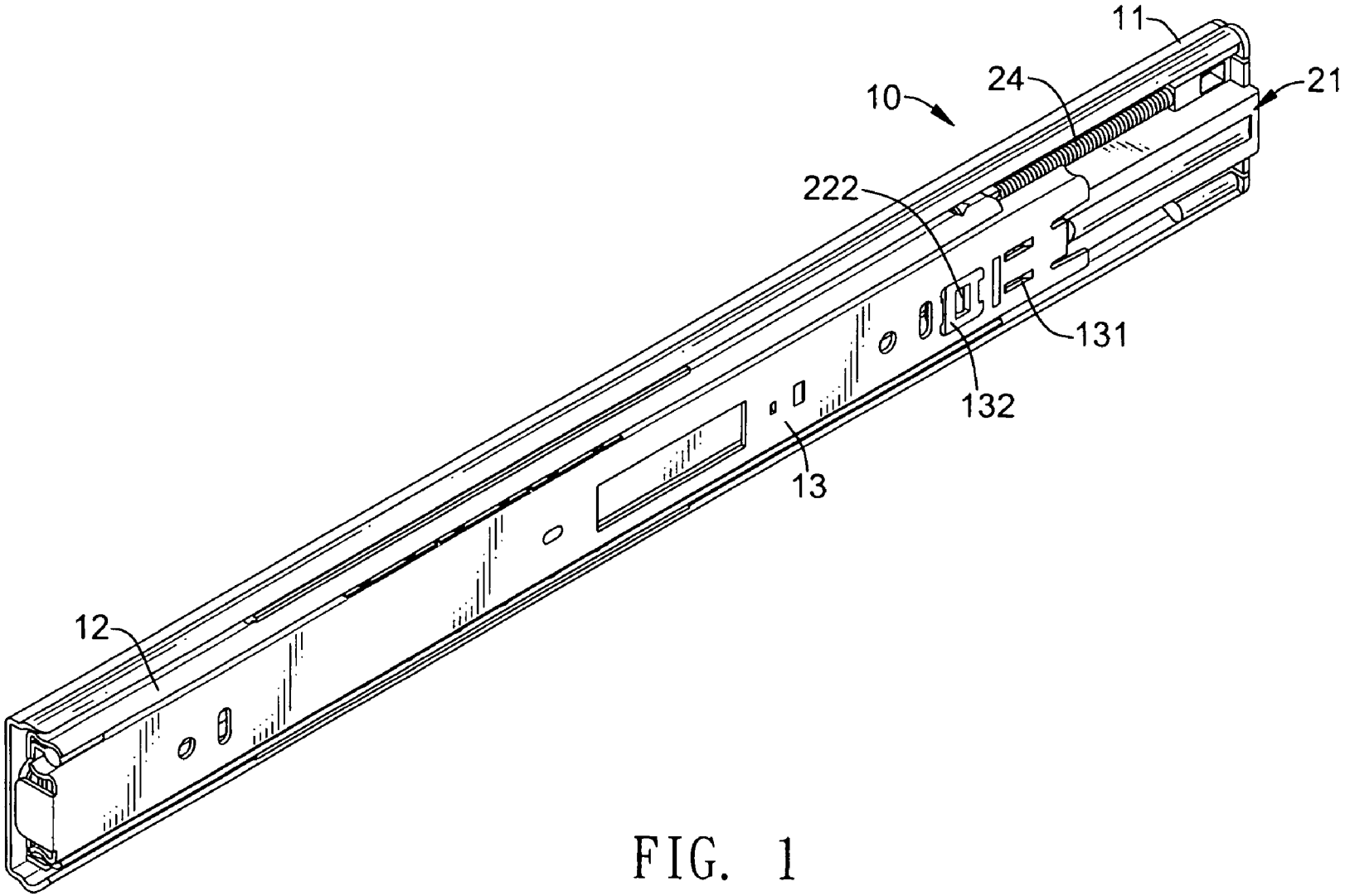
FIG. 1 is a perspective view of a drawer rail in accordance with the present invention.
Figure 2:
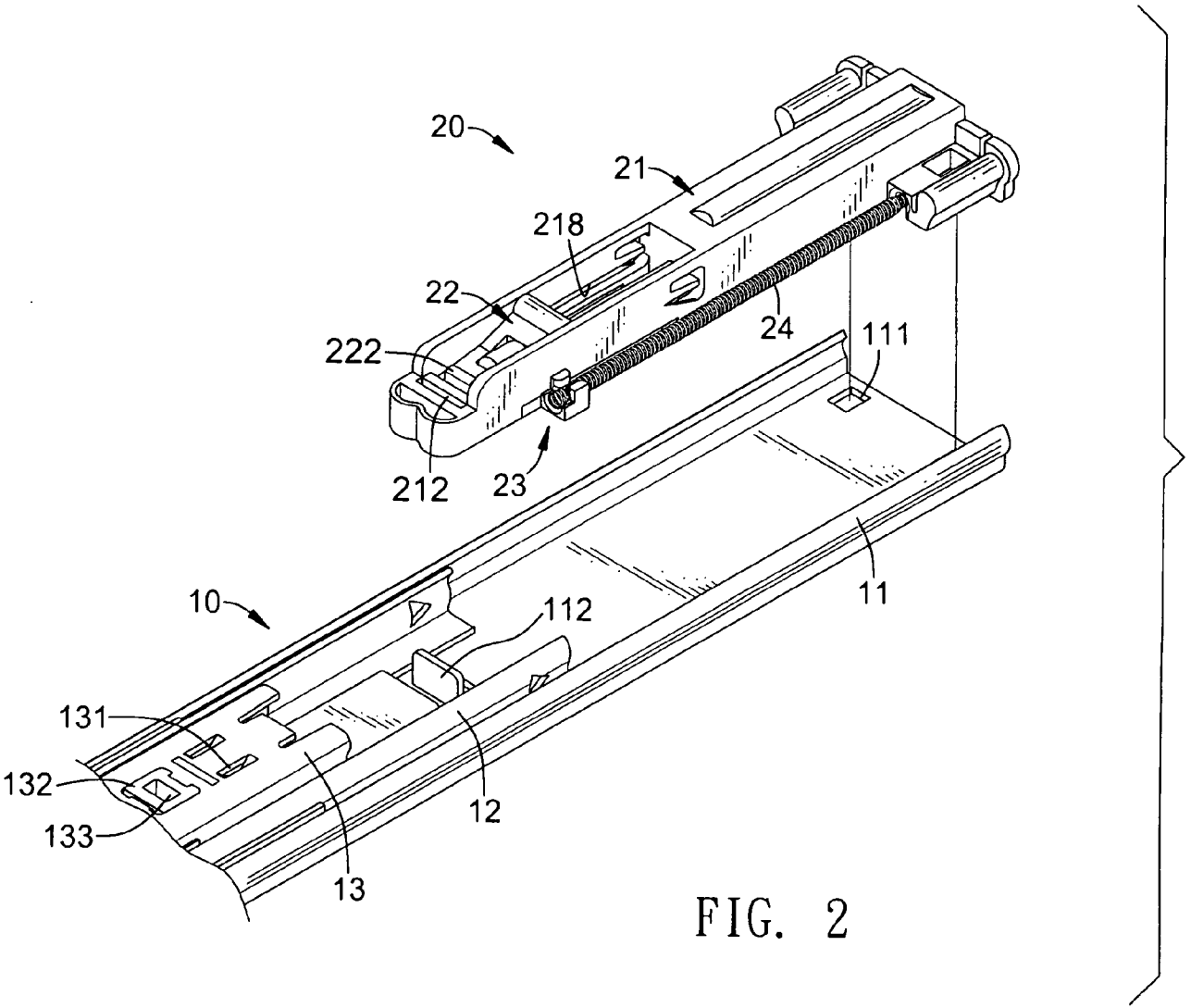
FIG. 2 is an enlarged, exploded, perspective view of the drawer rail in FIG. 1.
Figure 3:
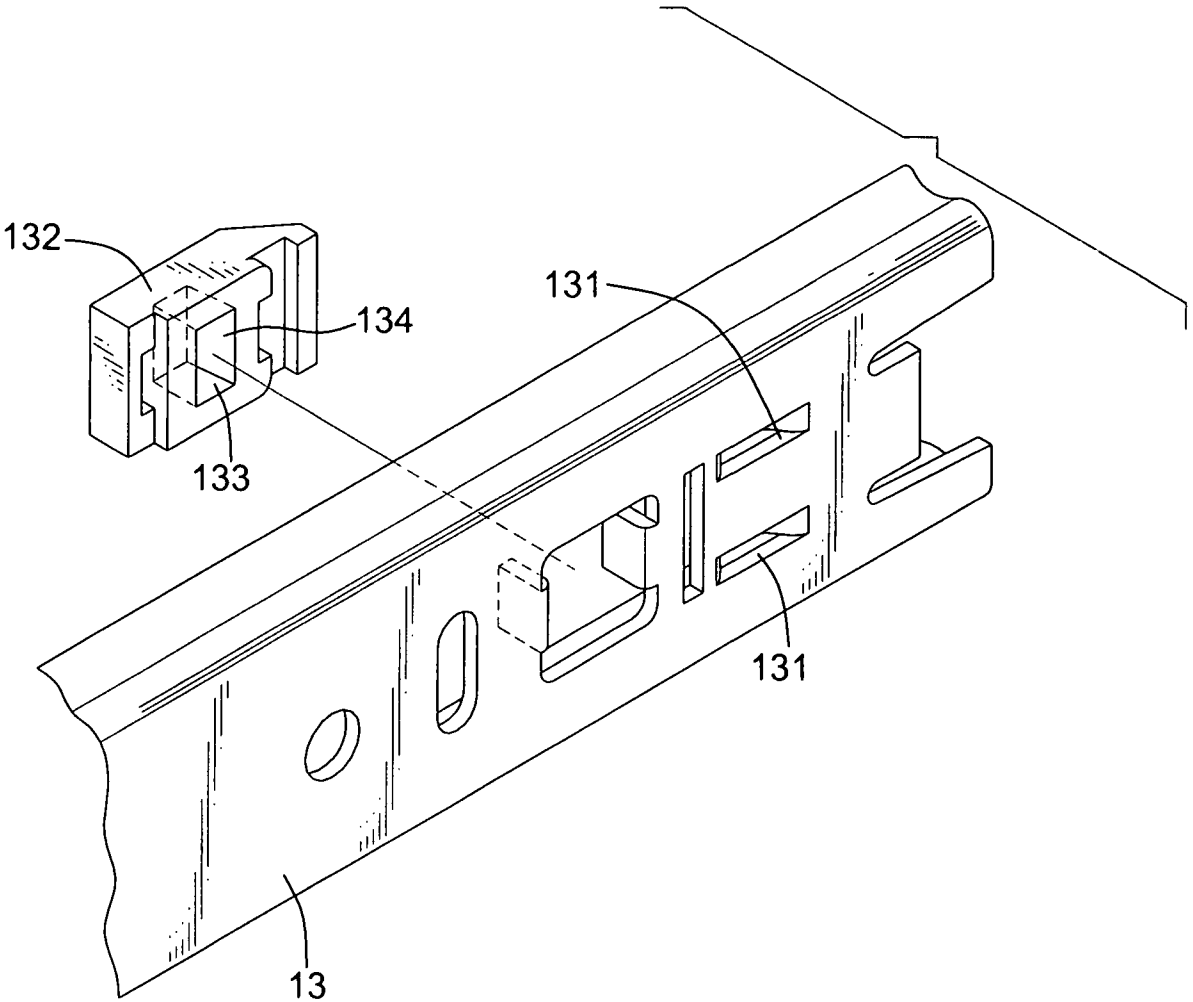
FIG. 3 is an enlarged, exploded, perspective view of an inner track of the drawer rail in FIG. 1.
Figure 4:
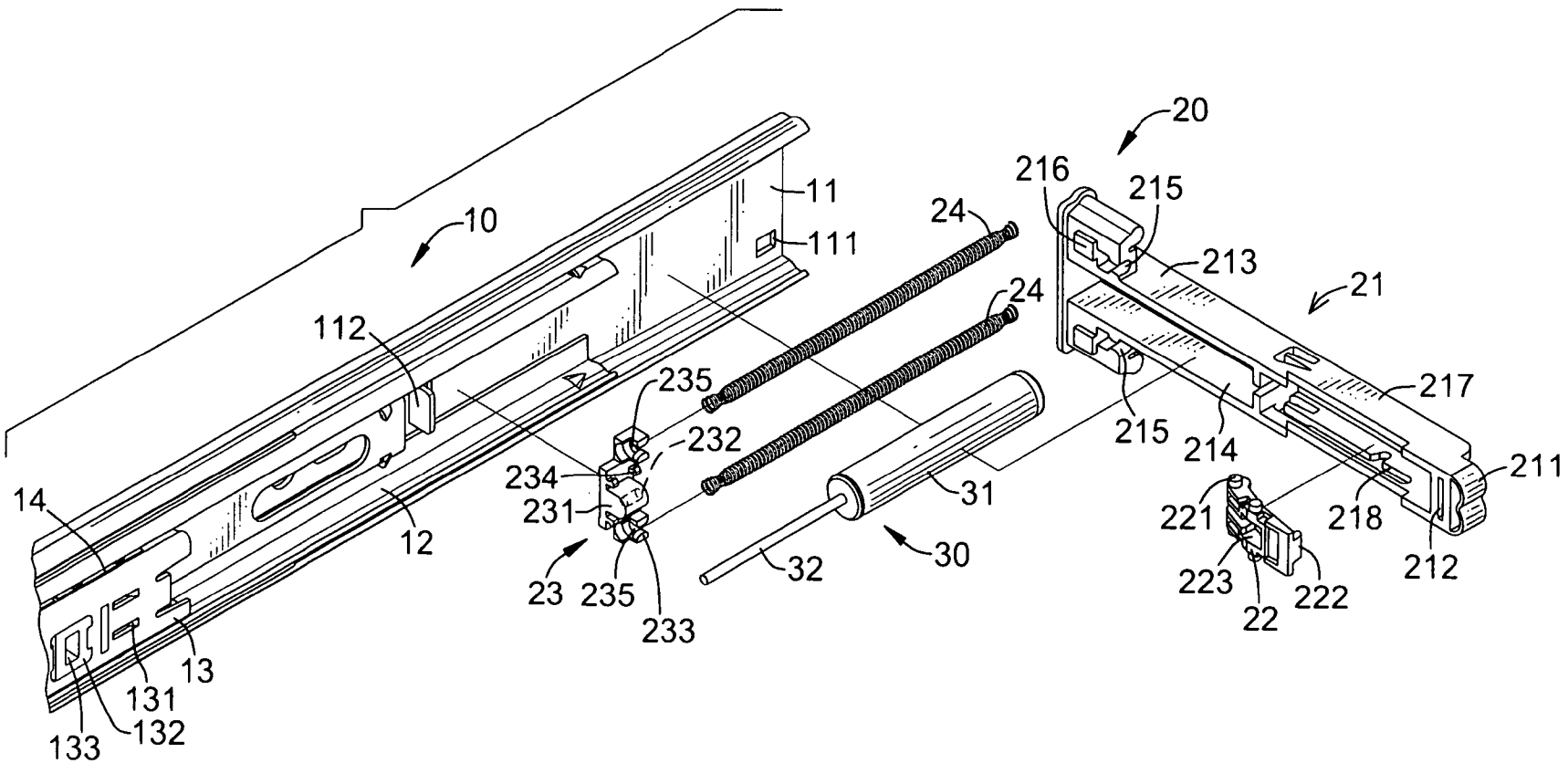
FIG. 4 is another, exploded, perspective view of the drawer rail in FIG. 1.
Figure 5:
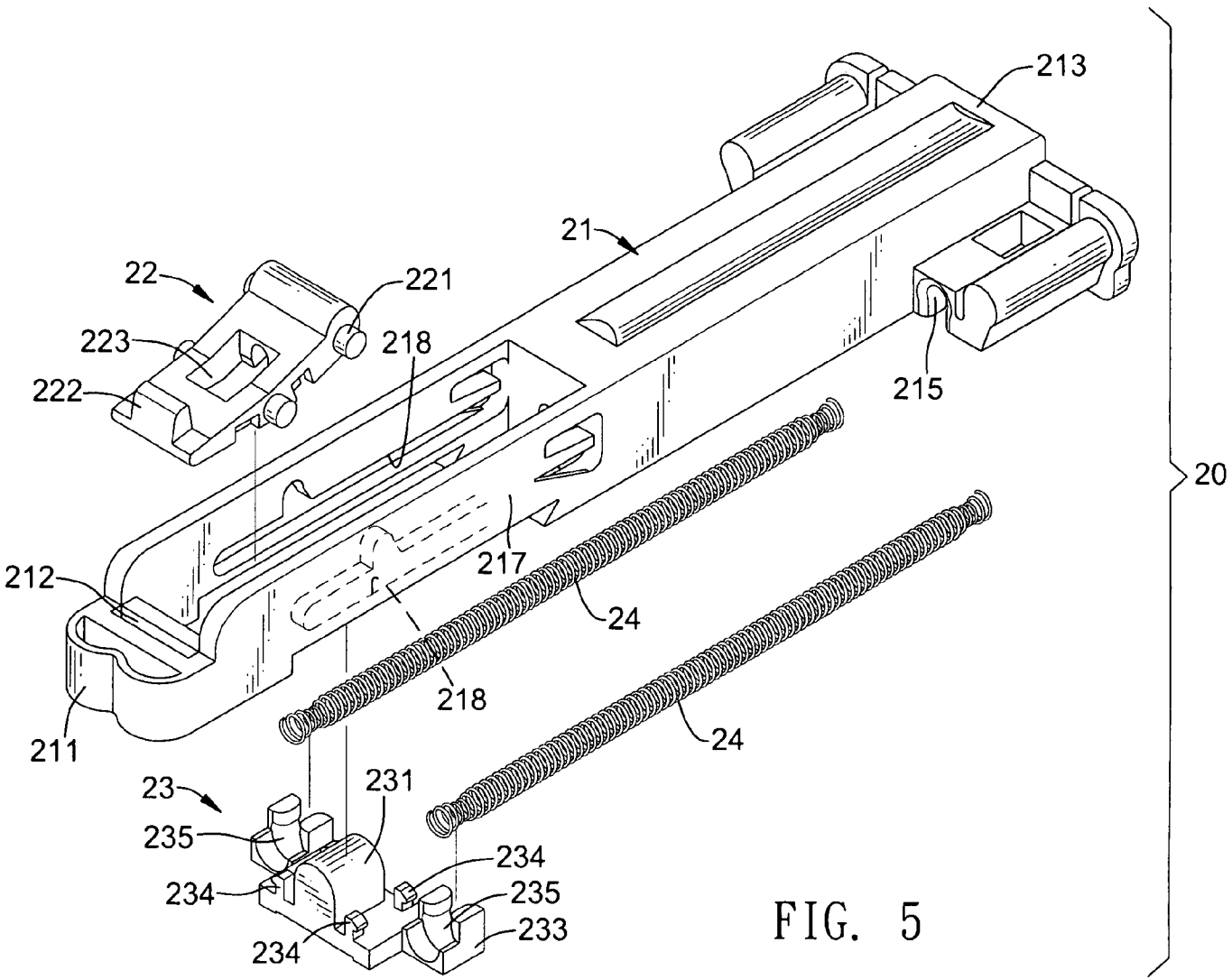
FIG. 5 is an enlarged, exploded, perspective view of an auto-returning device of the drawer rail in FIG. 1.

With reference to FIGS. 1 to 6, an auto-returning drawer rail in accordance with the present invention is mounted on furniture comprising a drawer cavity and a drawer and comprises a drawer rail assembly (10), an auto-returning device (20) and a buffering device (30).

The drawer rail assembly (10) is mounted in the drawer cavity and has a rail bracket (11), an outer track (12), an inner track (13) and multiple optional ball bearing races (14).

The rail bracket (11) is mounted securely in the drawer cavity and has a distal end, a proximal end, an internal surface, two optional mounting holes (111) and an optional inserting panel (112). The mounting holes (111) are formed through the internal surface of the outer track (11) near the proximal end. The inserting panel (112) is formed on and protrudes from the internal surface of the rail bracket (11) near the distal end.

The outer track (12) is mounted slidably on the internal surface of the rail bracket (11) and has an external surface and an internal surface. The external surface of the outer track (12) is mounted slidably on the internal surface of the rail bracket (11).

The inner track (13) is mounted slidably on the internal surface of the outer track (12), is mounted securely on the drawer and has a distal end, a proximal end, an internal surface, an external surface, two engaging blocks (131) and a hook (132). The engaging blocks (131) are formed on and protrude from the external surface of the inner track (13) near the proximal end and face the internal surface of the outer track (12). The hook (132) is formed on and protrudes from the external surface of the inner track (13) near the engaging blocks (131) and has a hooking hole (133) and an inclined face (134). The hooking hole (133) is formed through the hook (132). The inclined face (134) is formed in the hooking hole (133) near the engaging blocks (131).

The ball bearing races (14) are mounted in the drawer rail assembly (10) between the outer track (12) and the inner track (13) for smooth movement of the inner track (13) relative to the outer track (12).

The auto-returning device (20) is mounted on the drawer rail assembly (10) and has a base (21), a sliding block (22), a connector (23) and two springs (24).

The base (21) is mounted on the internal surface of the rail bracket (11) and has a front end (211), a rear end (213), two sidewalls (217) and two elongated grooves (218).

The front end (211) of the base (21) is mounted on the internal surface of the rail bracket (11) and may have an inserting hole (212). The inserting hole (212) is formed through the front end (211) of the base (21) and is mounted around the inserting panel (112) of the rail bracket (11).

The rear end (213) of the base (21) is mounted on the internal surface of the rail bracket (11) near the proximal end and has an external surface, two outer sides, a recess (214), two shoulder mounts (215) and two optional mounting blocks (216).

The external surface of the rear end (213) is mounted on the internal surface of the rail bracket (11).

The recess (214) is formed through the external surface of the rear end (213) of the base (21) and faces the internal surface of the rail bracket (11).

The shoulder mounts (215) are formed respectively on the outer sides of the rear end (213) of the base (21) and each shoulder mount (215) has an open end facing the front end (211) of the base (21).

The mounting blocks (216) are formed on and protrude from the external surface of the rear end (213) near the shoulder mounts (215), are mounted in the mounting holes (111) in the rail bracket (11) to mount the base (21) securely on the rail bracket (11).

The sidewalls (217) are formed on the base (21) between the front end (211) and the rear end (213) parallel to each other and each sidewall (217) has an inner side.

The elongated grooves (218) may be L-shaped, are respectively formed in the inner sides of the sidewalls (217).

The sliding block (22) may be curved, is mounted slidably on the base (21) between the sidewalls (217) and has two outer sides, a front end, a rear end, a middle, multiple sliding tabs (221), a clasp (222) and a mounting recess (223).

The sliding tabs (221) are formed on and protrude from the outer sides of the sliding block (22) near the rear end and the middle and are mounted slidably in the elongated grooves (218) of the base (21).

The clasp (222) is formed on the front end of the sliding block (22), engages the hooking hole (133) of the hook (132) of the inner track (13) and abutting the inclined face (134) of the hook (132).

The mounting recess (223) is formed in the middle of the sliding block (22) between the sliding tabs (221) and faces the internal surface of the rail bracket (11).

The connector (23) is mounted securely on the sliding block (22) between the rail bracket (11) and the base (21) and has a middle, a connecting block (231), a holding frame (233) and multiple clasping tabs (234). The connecting block (231) is formed on and protrudes from the middle of the connector (23), is mounted securely in the mounting recess (223) of the sliding block (22) and may have a rear side and a mounting hole (232). The rear side of the connecting block (231) faces the rear end (213) of the base (21). The mounting hole (232) is formed in the rear side of the connecting block (231). The holding frame (233) is formed on and protrudes from the connecting block (231) and has two spring mounts (235). The spring mounts (235) of the holding frame (233) protrude out of and abut the sidewalls (217) of the base (21) and align with the shoulder mounts (215) to make the connector (23) moving along the sidewalls (217) of the base (21). The clasping tabs (234) may be L-shaped, are formed on and protrude from the holding frame (233) between the spring mounts (235) of the holding frame (233) and the connecting block (231) and are mounted in the base (21) and respectively engage the sidewalls (217) of the base (21) in the elongated grooves (218).

The springs (24) are connected to the base (21) and the connector (23) to pull the sliding block (22) along the elongated grooves (218) and each spring (24) has a distal end and a proximal end. The proximal ends of the springs (24) are attached securely to the shoulder mounts (215). The distal ends of the springs (24) are connected to the spring mounts (235) of the holding frame (233).

The buffering device (30) is mounted in the auto-returning device (20) between the base (21) and the rail bracket (11) and has a damper (31) and a drive shaft (32). The damper (31) is mounted securely in the recess (214) of the base (21) and has front end. The drive shaft (32) is mounted slidably in the damper (31), is connected to the connector (23), and may be connected to the mounting hole (232) of the connector (23).

Figure 6:
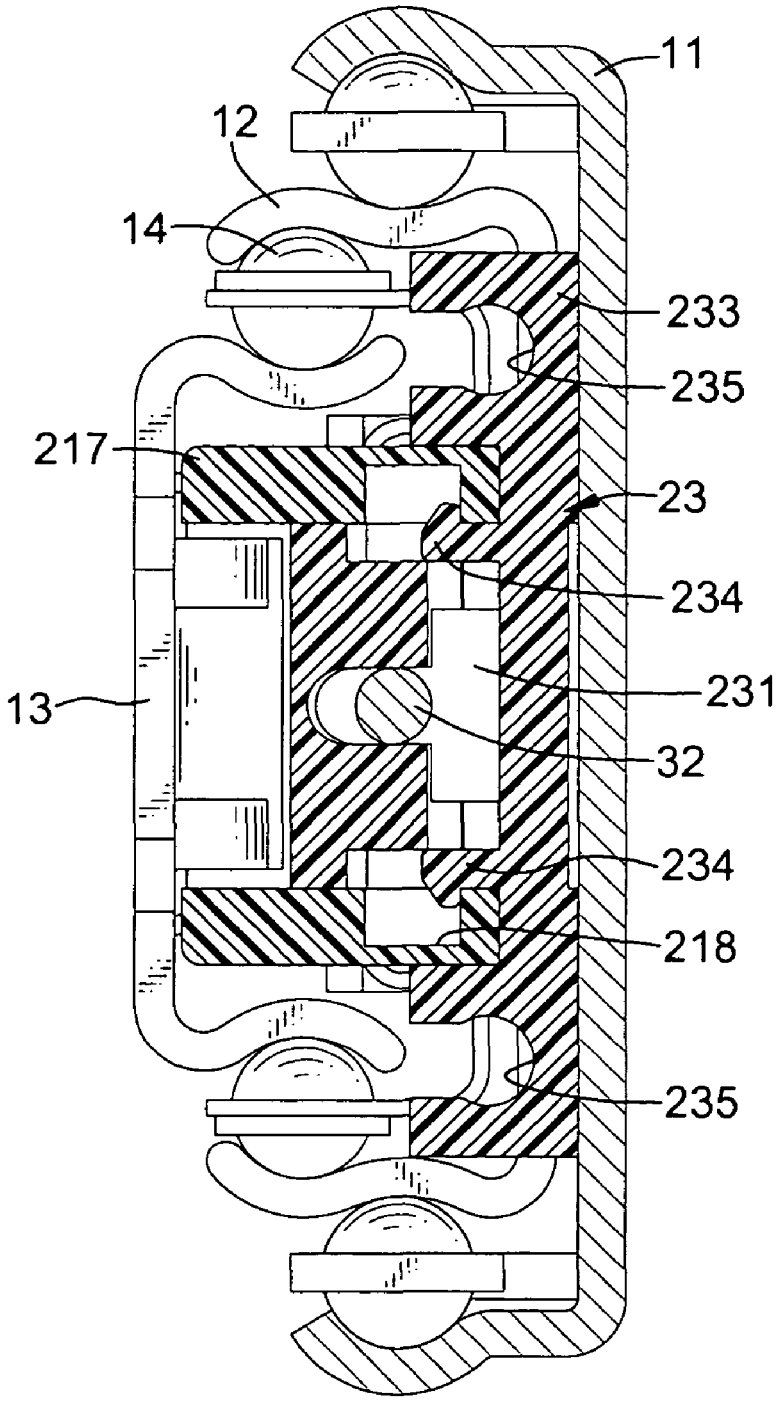
FIG. 6 is a cross sectional, rear view of the auto-returning drawer rail in FIG. 1.
Figure 7:
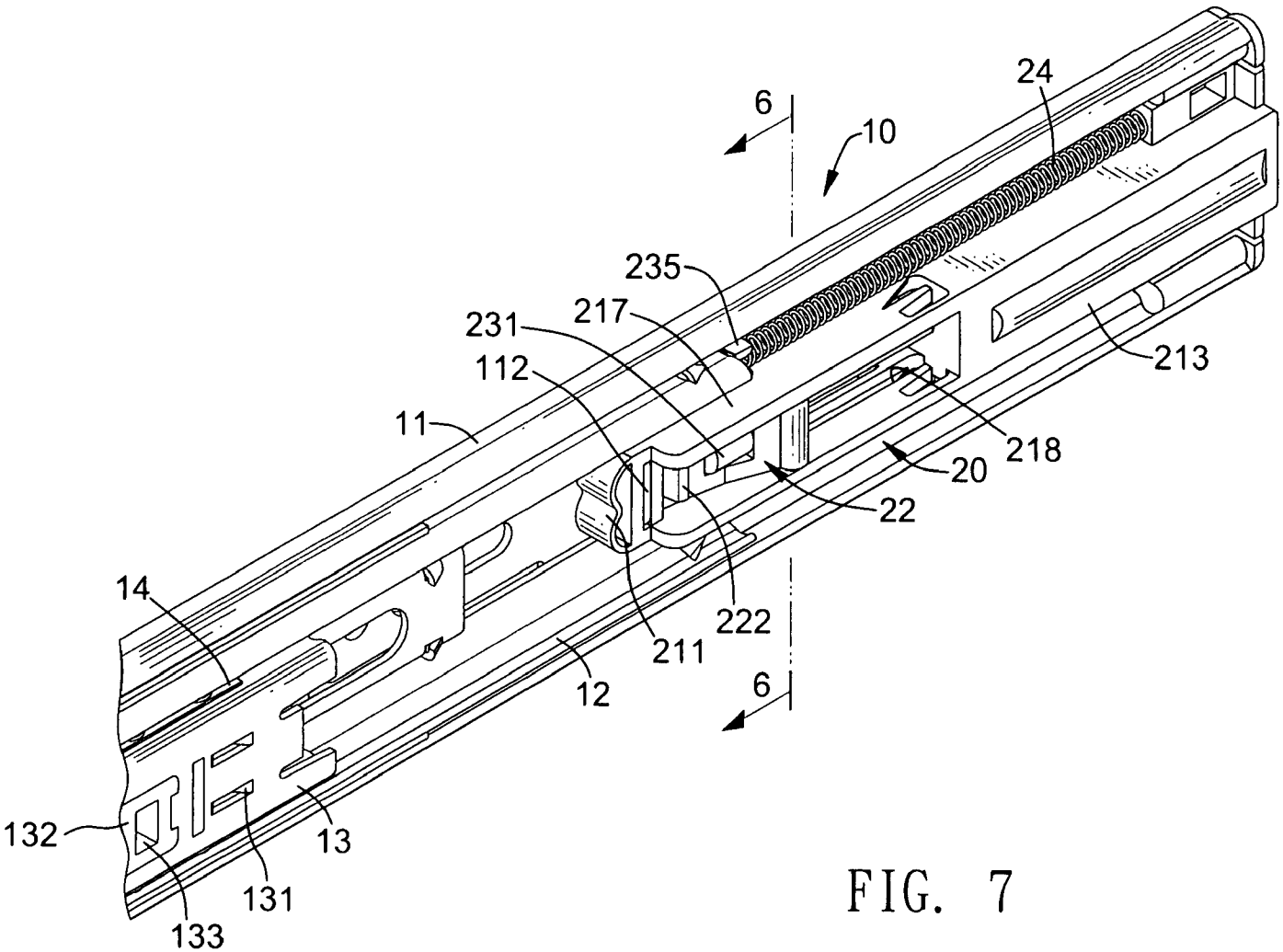
FIG. 7 is an operational, perspective view of the drawer rail in FIG. 1, shown with the drawer rail extended.

With further reference to FIGS. 6 and 7, when the drawer is opened, the inner track (13) moves relative to the rail bracket (11) of the drawer rail assembly (10) and the hook (132) will pull the sliding block (22) along the elongated grooves (218) to the front end (211) of the base (21) by the hooking hole (133) engaging the clasp (222). The inner track (13) will further move forward when the sliding block (22) engages the elongated grooves (218) near the front end (211) of the base (21) causing the hook (132) to be released from the clasp (222). The connector (23) will move smoothly and steadily with the sliding block (22) along the elongated grooves (218) in the sidewalls (217) of the base (21) by the clasping tabs (234) engaging the sidewalls (217) of the base (21) in the elongated grooves (218). The springs (24) are stretched when the connector (23) is moved with the sliding block (22). When the connector (23) moves with the sliding block (22), the drive shaft (32) is moved with the connector (23) relative to the base (21).

Figure 8:
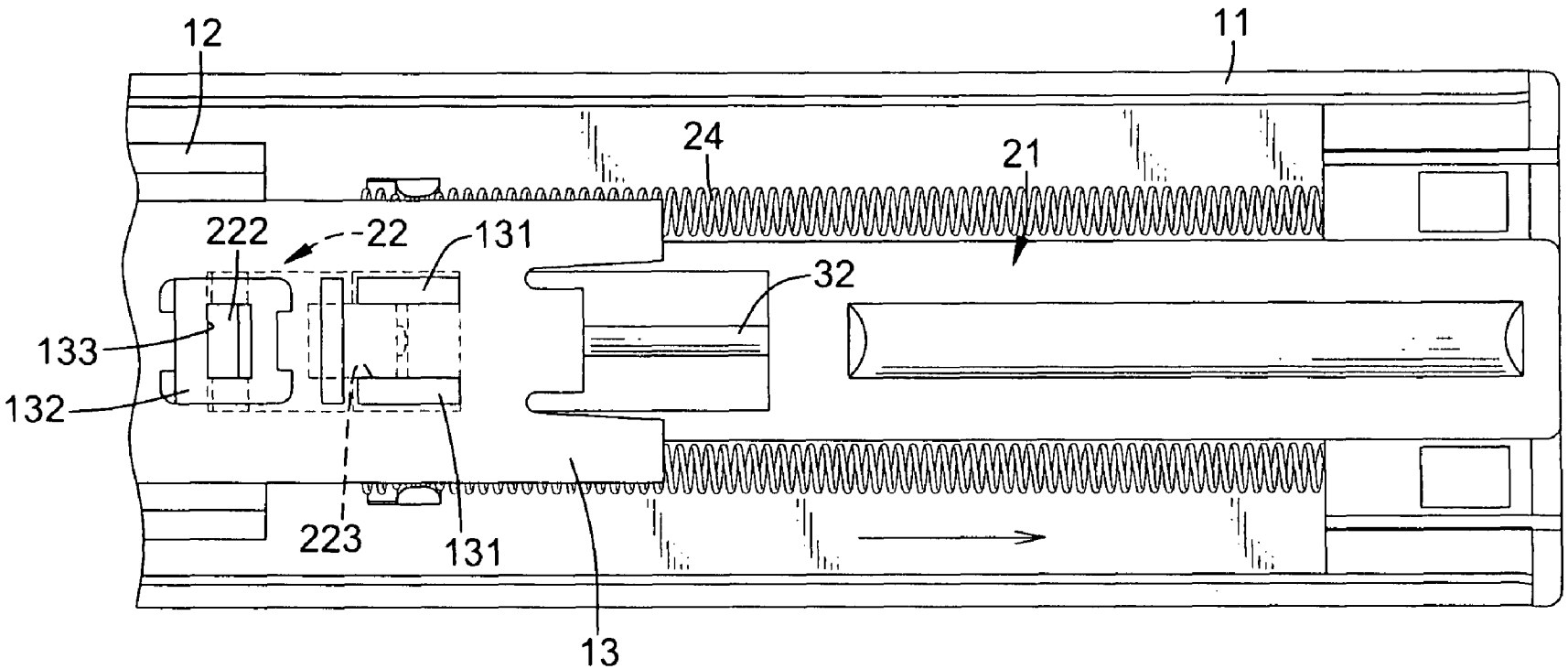
FIG. 8 is an operational side view of the drawer rail in FIG. 1, shown returning.
Figure 9:
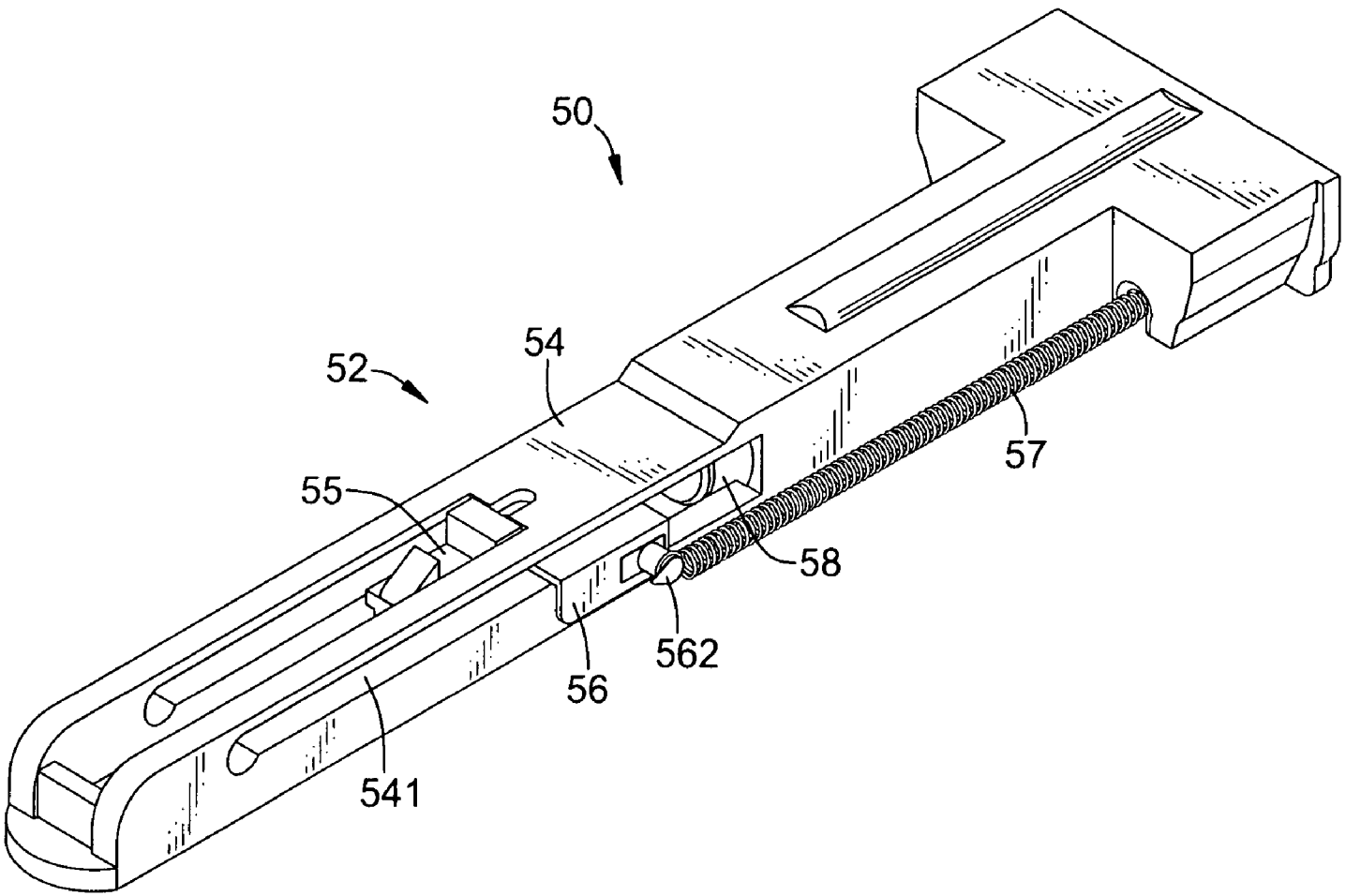
FIG. 9 PRIOR ART
FIG. 9 is a perspective view of an auto-returning drawer rail in accordance with the prior art.
Figure 10:
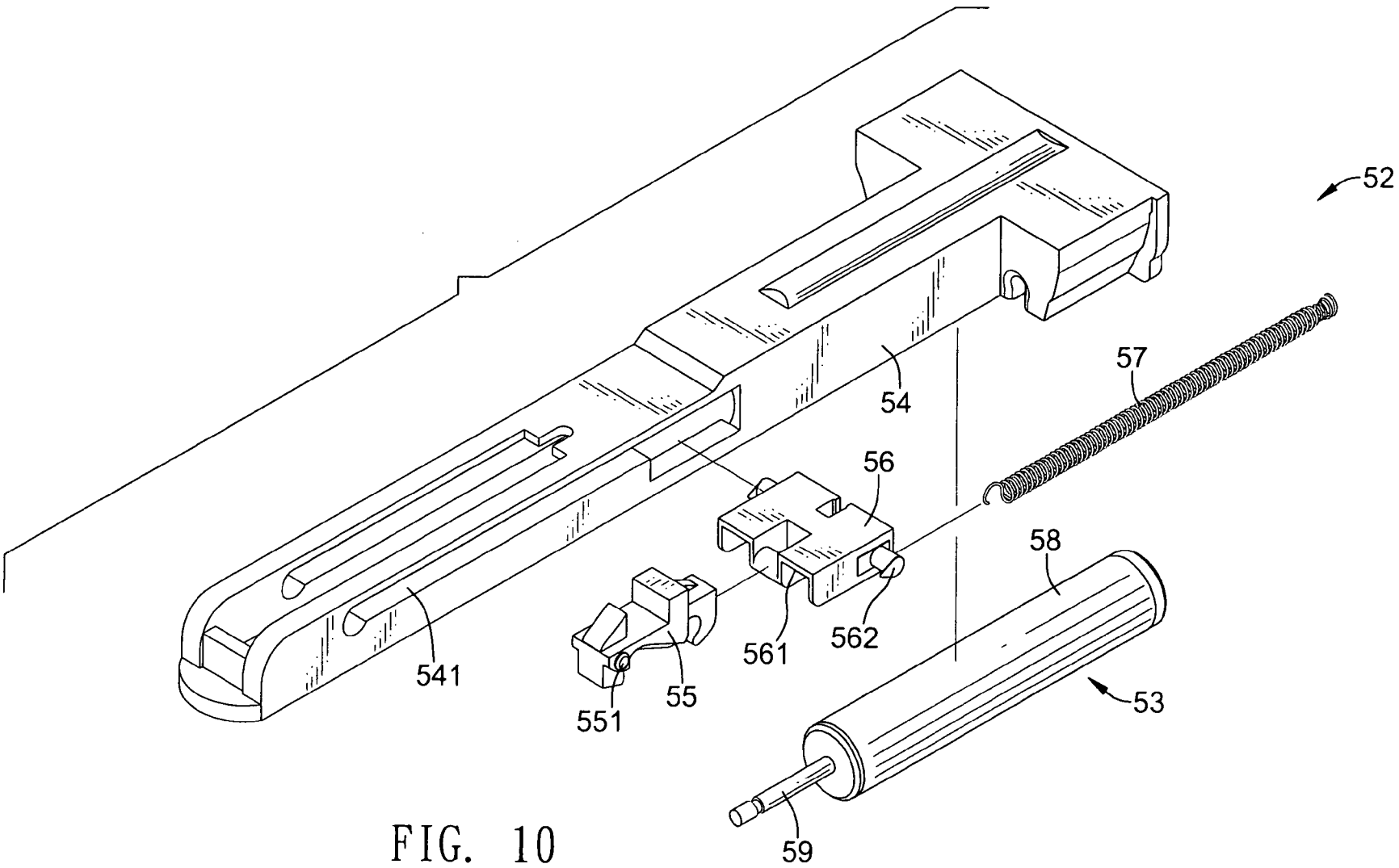
FIG. 10 is an exploded, perspective view of the auto-returning drawer rail in FIG. 9.
Figure 11:
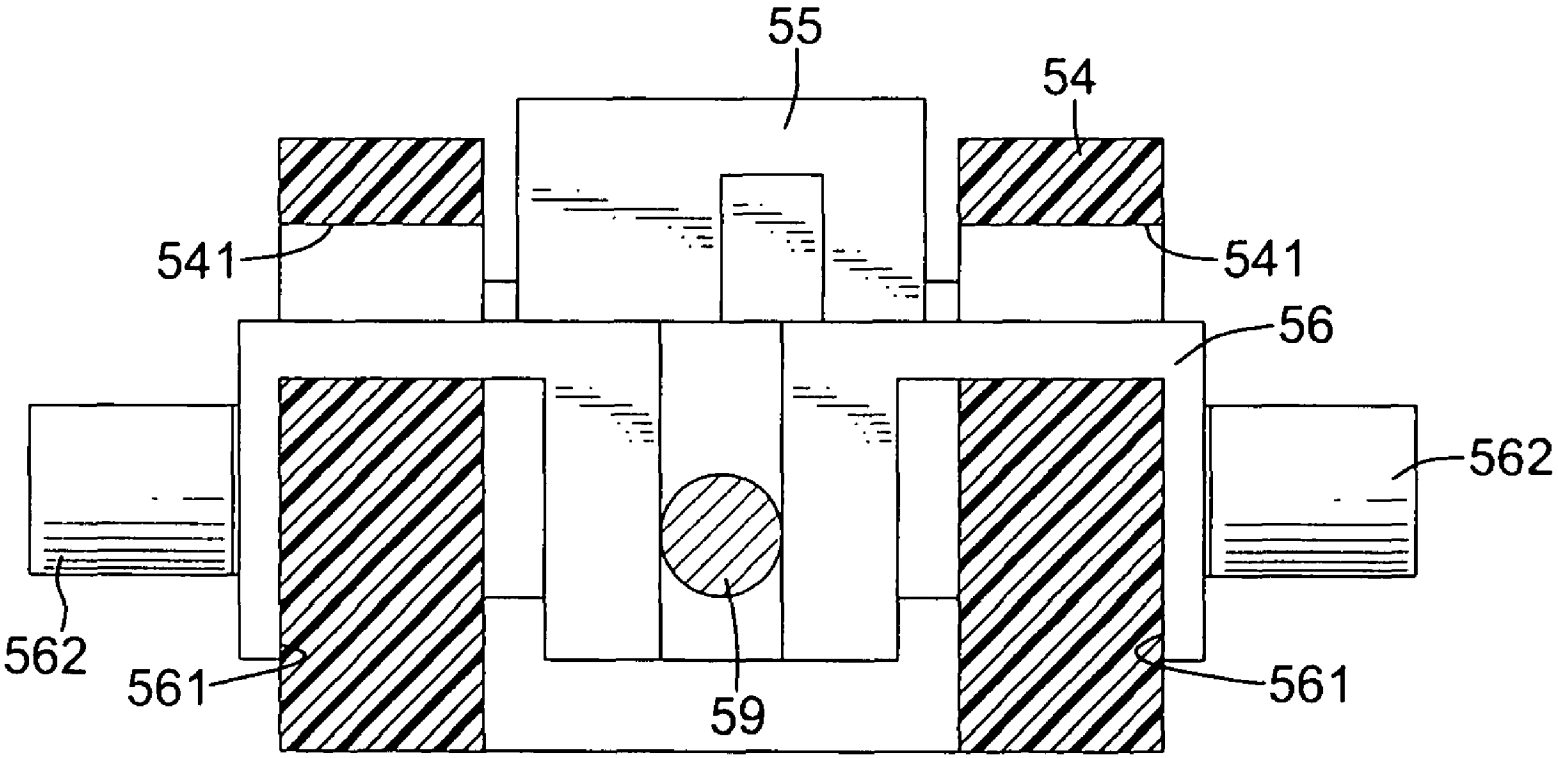
FIG. 11 PRIOR ART
FIG. 11 is a cross sectional, rear view of the auto-returning drawer rail in FIG. 9.
Figure 12:
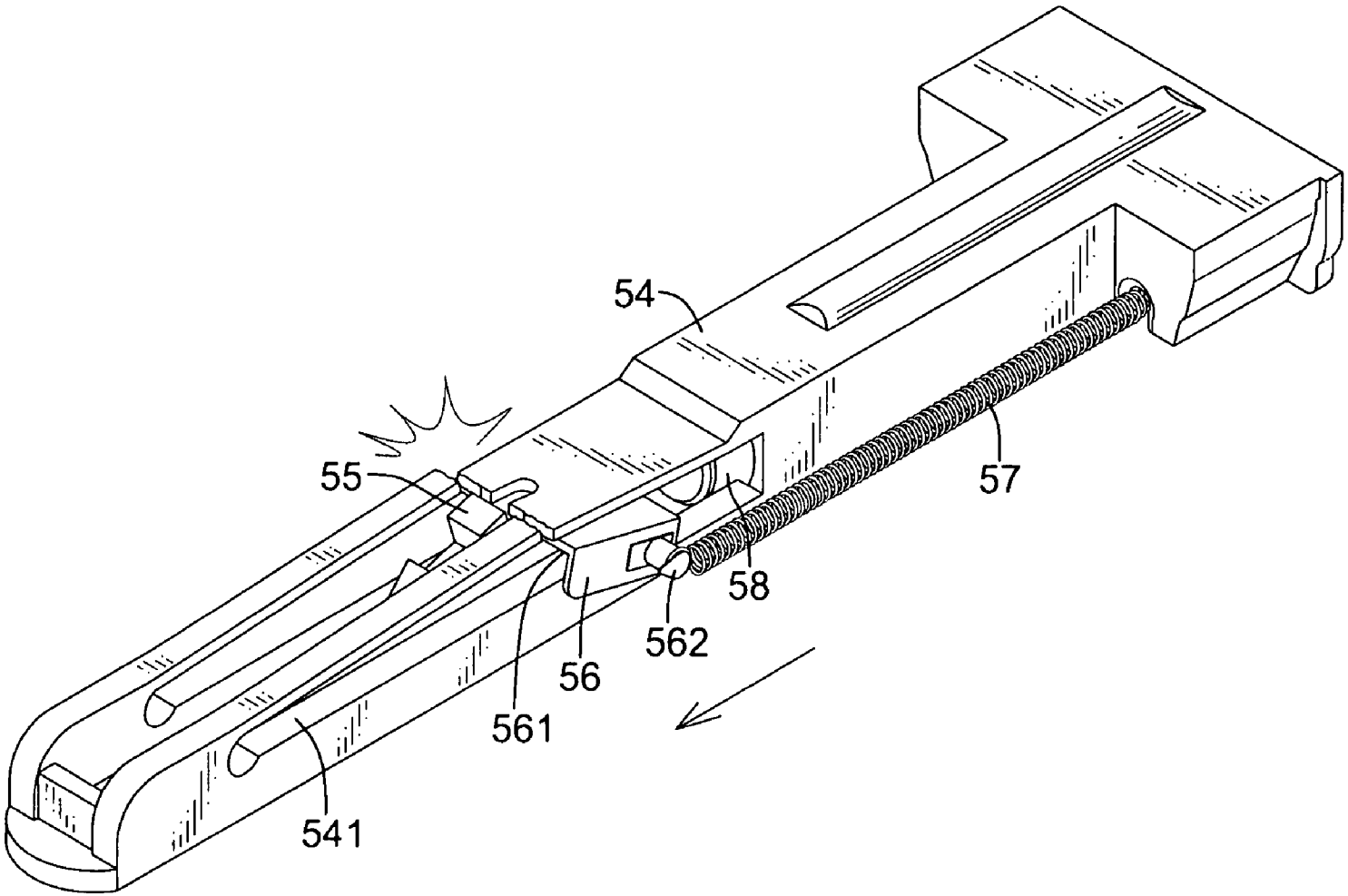
FIG. 12 PRIOR ART
FIG. 12 is an operational perspective view of the auto-returning drawer rail in FIG. 9.

With reference to FIG. 8, when the drawer is pushed backward, the sliding block (22) moves back along the elongated grooves (218) to the rear end (213) of base (21) due to the engaging block (131) pushing the sliding block (22) and the hooking hole (133) engaging the clasp (222) to make the inner track (13) moving backward with the sliding block (22) and the connector (23). Meanwhile, the damper (31) prevents the drawer from gaining too much speed and being damaged. Since the drawer is returned, the drawer is not an injury hazard to passers-by.

Moreover, the elongated grooves (218) are formed in the inner sides of the sidewalls (217) of the base (21), are not formed through the sidewalls (217) of the base (21) and this enhances structural strength of the base (21). In addition, the connector (23) moves smoothly and steadily with the sliding block (22) along the elongated grooves (218) in the sidewalls (217) of the base (21) by the clasping tabs (234) engaging the sidewalls (217) of the base (21) in the elongated grooves (218). Then, the connector (23) will not move upward and press against the base (21) when moving forward along the elongated grooves (218) of the base (21) by the sliding block (22) so preventing the base (21) from being broken by the connector (23). Consequently, life span of the base (21) of the auto-returning device (20) will be longer than a conventional base (54).

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A drawer rail being mounted in furniture having a drawer cavity and a drawer, the drawer rail comprising a drawer rail assembly being adapted to mount in the drawer cavity and having a rail bracket being adapted to be mounted securely in the drawer cavity and having a distal end;

a proximal end; and an internal surface;

an outer track being mounted slidably on the internal surface of the rail bracket and having an external surface being mounted slidably on the internal surface of the rail bracket; and an internal surface; and an inner track being mounted slidably on the internal surface of the outer track, being adapted to mount securely on the drawer and having a distal end;

a proximal end;

an internal surface;

an external surface;

two engaging blocks being formed on and protruding from the external surface of the inner track near the distal end and facing the internal surface of the outer track; and a hook being formed on and protruding from the external surface of the inner track near the engaging blocks and having a hooking hole being formed through the hook; and an inclined face being formed in the hooking hole near the engaging blocks;

an auto-returning device being mounted on the drawer rail assembly and having a base being mounted on the internal surface of the rail bracket and having a front end being mounted on the internal surface of the rail bracket;

a rear end being mounted on the internal surface of the rail bracket near the proximal end and having an external surface being mounted on the internal surface of the rail bracket;

two outer sides;

a recess being formed through the external surface of the rear end of the base and facing the internal surface of the rail bracket; and two shoulder mounts being formed respectively on the outer sides of the rear end of the base and each shoulder mount having an open end facing the front end of the base;

two sidewalls being formed on the base between the front end and the rear end parallel each other and each sidewall having an inner side; and two elongated grooves being respectively formed in the inner sides of the sidewalls;

a sliding block being mounted slidably on the base between the sidewalls and having two outer sides;

a front end;

a rear end;

a middle;

multiple sliding tabs being formed on and protruding from the outer sides of the sliding block near the rear end and the middle and being mounted slidably in the elongated grooves of the base;

a clasp being formed on the front end of the sliding block, engaging the hooking hole of the hook of the inner track and abutting the inclined face of the hook; and a mounting recess being formed in the middle of the sliding block between the sliding tabs and facing the internal surface of the rail bracket;

a connector being mounted securely on the sliding block between the rail bracket and the base and having a middle;

a connecting block being formed on and protruding from the middle of the connector, being mounted securely in the mounting recess of the sliding block; and a holding frame being formed on and protruding from the connecting block and having two spring mounts protruding out of and abutting the sidewalls of the base and aligning with the shoulder mounts; and multiple clasping tabs being formed on and protruding from the holding frame between the spring mounts and the connecting block and being mounted in the base and respectively engaging the sidewalls of the base in the elongated grooves; and two springs being connected to the base and the connector and each spring having a proximal end being attached securely to a corresponding shoulder mount; and a distal end being connected to a corresponding spring mount of the holding frame; and a buffering device being mounted in the auto-returning device between the base and the rail bracket and having a damper being mounted securely in the recess of the base and having a front end; and a drive shaft being mounted slidably in the damper, being connected with the connector and having an inner end extending into the damper from the front end of the damper; and an outer end extending out of the front end of the damper and being connected to the connector.

2. The drawer rail as claimed in claim 1, wherein each clasping tab is L-shaped;

the rail bracket has two mounting holes being formed through the internal surface of the outer track near the distal end; and an inserting panel being formed on and protruding from the internal surface of the rail bracket; and the front end of the base has an inserting hole being formed through the front end of the base and being mounted around the inserting panel of the rail bracket; and the rear end of the base has two mounting blocks being formed on and protruding from the external surface of the rear end near the shoulder mounts, being mounted in the mounting holes in the rail bracket to mount the base securely on the rail bracket.

3. The drawer rail as claimed in claim 2, wherein the connecting block has a rear side facing the rear end of the base; and a mounting hole being formed in the rear side of the connecting block; and the outer end of the drive shaft is connected to the mounting hole of the connecting block.

4. The drawer rail as claimed in claim 3, wherein the drawer rail assembly has multiple ball bearing races being mounted in the drawer rail assembly between the outer track and the inner track.

5. The drawer rail as claimed in claim 1, wherein the connecting block has a rear side facing the rear end of the base; and a mounting hole being formed in the rear side of the connecting block; and the outer end of the drive shaft is connected to the mounting hole of the connecting block.

6. The drawer rail as claimed in claim 5, wherein the drawer rail assembly has multiple ball bearing races being mounted in the drawer rail assembly between the outer track and the inner track.

7. The drawer rail as claimed in claim 1, wherein the drawer rail assembly has multiple ball bearing races being mounted in the drawer rail assembly between the outer track and the inner track.

8. The drawer rail as claimed in claim 2, wherein the drawer rail assembly has multiple ball bearing races being mounted in the drawer rail assembly between the outer track and the inner track.

* * * * *